US009935396B2

(12) United States Patent
Endo et al.

(10) Patent No.: US 9,935,396 B2
(45) Date of Patent: Apr. 3, 2018

(54) CONNECTOR HAVING FIRST AND SECOND HOUSINGS AND A SLIDING MEMBER IMPLEMENTING A CONNECTOR POSITION ASSURANCE FUNCTION

(71) Applicant: Dai-ichi Seiko Co., Ltd., Kyoto-shi, Kyoto (JP)

(72) Inventors: Takayoshi Endo, Shizuoka (JP); Hiroyuki Kurita, Shizuoka (JP)

(73) Assignee: DAI-ICHI SEIKO CO., LTD., Kyoto-Shi, Kyoto (JP)

( * ) Notice: Subject to any disclaimer, the term of this patent is extended or adjusted under 35 U.S.C. 154(b) by 0 days.

(21) Appl. No.: 15/444,046

(22) Filed: Feb. 27, 2017

(65) Prior Publication Data

US 2017/0256887 A1 Sep. 7, 2017

(30) Foreign Application Priority Data

Mar. 3, 2016 (JP) ..... 2016-040570

(51) Int. Cl.
*H01R 13/627* (2006.01)
*H01R 13/629* (2006.01)

(52) U.S. Cl.
CPC ..... *H01R 13/629* (2013.01); *H01R 13/6271* (2013.01)

(58) Field of Classification Search
CPC ..... H01R 13/639; H01R 13/641
USPC ..... 439/352, 489
See application file for complete search history.

(56) References Cited

U.S. PATENT DOCUMENTS 4,370,013 A * 1/1983 Niitsu ..... H01R 13/6272 439/352
5,628,648 A * 5/1997 Higgins, Jr. ..... H01R 13/6272 439/352
5,759,058 A * 6/1998 Childs ..... H01R 13/641 439/352
6,186,819 B1 2/2001 Holub
6,435,895 B1 8/2002 Fink et al.
6,716,052 B2 * 4/2004 Kane ..... H01R 13/641 439/352

(Continued)

FOREIGN PATENT DOCUMENTS

EP 1049213 A1 11/2000
EP 1128486 A2 8/2001

(Continued)

OTHER PUBLICATIONS

European Search Report, dated Apr. 19, 2017, 8 pages.
Notification of Reasons for Refusal (JP Patent Applicaiton No. 2016-040570); dated Oct. 31, 2017; 6 pages.

*Primary Examiner* — Abdullah Riyami
*Assistant Examiner* — Vladimir Imas
(74) *Attorney, Agent, or Firm* — Howard & Howard Attorneys PLLC

(57) ABSTRACT

A connector includes an outer housing, an inner housing to be engaged with the outer housing, and a sliding member. The sliding member includes a first protrusion formed at the leading end part (+Y side) of a first support arm and protruding inwardly (−X-axis direction) that is at a main-arm side, and a second protrusion formed at the leading end part (+Y side) of a second support arm and protruding inwardly (+X-axis direction) that is at the main-arm side.

4 Claims, 17 Drawing Sheets

(56) References Cited

U.S. PATENT DOCUMENTS

| | | | | |
|---|---|---|---|---|
| 7,175,451 | B2 * | 2/2007 | Shuey | H01R 13/641 439/157 |
| 7,326,074 | B1 * | 2/2008 | Lim | H01R 13/629 439/352 |
| 8,016,606 | B1 * | 9/2011 | Kwan | H01R 13/641 439/352 |
| 8,678,846 | B2 * | 3/2014 | Hitchcock | H01R 13/6272 439/352 |
| 8,747,146 | B2 * | 6/2014 | Brown | H01R 13/639 439/489 |
| 8,920,187 | B2 * | 12/2014 | Kon | H01R 13/6272 439/352 |
| 8,926,355 | B2 * | 1/2015 | Heil | H01R 13/6275 439/352 |
| 8,926,356 | B2 * | 1/2015 | Kon | H01R 13/6272 439/352 |
| 9,160,095 | B2 * | 10/2015 | Littek | H01R 13/422 |
| 9,231,342 | B2 * | 1/2016 | Kataoka | H01R 13/639 |
| 9,281,619 | B2 * | 3/2016 | Morello | H01R 13/639 |
| 9,425,534 | B2 * | 8/2016 | Schmidt | H01R 13/6272 |
| 9,490,576 | B2 * | 11/2016 | Plazio | H01R 13/641 |
| 9,680,256 | B1 * | 6/2017 | Lane | H01R 13/639 |
| 9,705,228 | B2 * | 7/2017 | Caldwell | H01R 13/4365 |
| 2002/0009923 | A1 | 1/2002 | Kashiyama et al. | |

FOREIGN PATENT DOCUMENTS

| | | | |
|---|---|---|---|
| EP | 1926183 | A2 | 5/2008 |
| JP | 2000-58199 | A | 2/2000 |
| JP | 2008277035 | | 11/2008 |
| JP | 4657034 | B2 | 3/2011 |
| JP | 2013-187116 | A | 9/2013 |
| WO | 2015/160747 | A2 | 10/2015 |
| WO | 2015/160757 | A2 | 10/2015 |

* cited by examiner

CONNECTOR HAVING FIRST AND SECOND HOUSINGS AND A SLIDING MEMBER IMPLEMENTING A CONNECTOR POSITION ASSURANCE FUNCTION

CROSS-REFERENCE TO RELATED APPLICATION

This application claims the benefit of Japanese Patent Application No. 2016-040570, filed on Mar. 3, 2016, the entire disclosure of which is incorporated by reference herein.

TECHNICAL FIELD

This application relates generally to a connector.

BACKGROUND ART

Japanese Patent No. 4657034 discloses a connector that has a Connector Position Assurance (CPA) function. This connector includes a first housing a second housing to be engaged with the first housing, and further a sliding member. The sliding member is slidably attached to the second housing so as to be enabled to slide from the first position (standby position) that is the initial position to a predetermined second position (engagement locking position) upon completion of the engagement of the second housing with the first housing. This sliding member functions as a CPA member that allows a user to check the completion of the engagement between both the outer and inner housings when slid from the first position to the second position.

The sliding member applied to the connector disclosed in Japanese Patent No. 4657034 includes a pair of arms that extend in the direction in which the sliding member slides. Since the pair of arms are disposed so as to be apart from each other, the arms of the respective sliding members may be entangled with each other within a part feeder that supplies the sliding members to an assembling machine which assembles the connector, disrupting the supply of the sliding member to the assembling machine.

The present disclosure has been made in view of the foregoing circumstances, and an objective is to provide a connector that employs a structure preventing sliding members from being entangled with each other.

SUMMARY OF THE INVENTION

In order to accomplish the above objective, a connector according to an aspect of the present disclosure includes:

a first housing;

a second housing includes a slide channel, the second housing being to be engaged with the first housing; and a sliding member capable of passing through the slide channel, and locking an engagement between the first housing and the second housing when moved to a predetermined position, in which the sliding member includes:

a base;

a first arm protruding from the base in a predetermined direction;

second and third arms protruding from the base in the predetermined direction and interposing the first arm between the second and third arms;

a first protrusion formed at a leading end of the second arm and protruding in a direction toward the first arm; and a second protrusion formed at a leading end of the third arm and protruding in the direction toward the first arm.

In the above connector, the first protrusion and the second protrusion may be provided at locations free from an interference with a passing-through action of the sliding member over the slide channel.

In the above connector, the sliding member may further include:

a fourth arm protruding in the predetermined direction from a part of the base between the first arm and the second arm; and a fifth arm protruding in the predetermined direction from a part of the base between the first arm and the third arm.

In the above connector, the fourth arm and the fifth arm may be formed at locations free from an interference with the passing-through action of the sliding member over the slide channel.

The connector may further include a third protrusion protruding from a leading end of the first arm.

According to the present disclosure, since a protrusion is formed in the space between the second arm and the third arm, such a protrusion prevents the second arm, and the like, of the other sliding member from entering this space, thereby preventing the respective sliding members from being entangled with each other.

BRIEF DESCRIPTION OF THE DRAWINGS

A more complete understanding of this application can be obtained when the following detailed description is considered in conjunction with the following drawings, in which.

DETAILED DESCRIPTION OF THE INVENTION

A connector 1 according to an embodiment of the present disclosure will be explained below with reference to the accompanying figures. In order to facilitate understanding to the present disclosure, an XYZ coordinate system will be defined and referred as appropriate.

Figure 1:
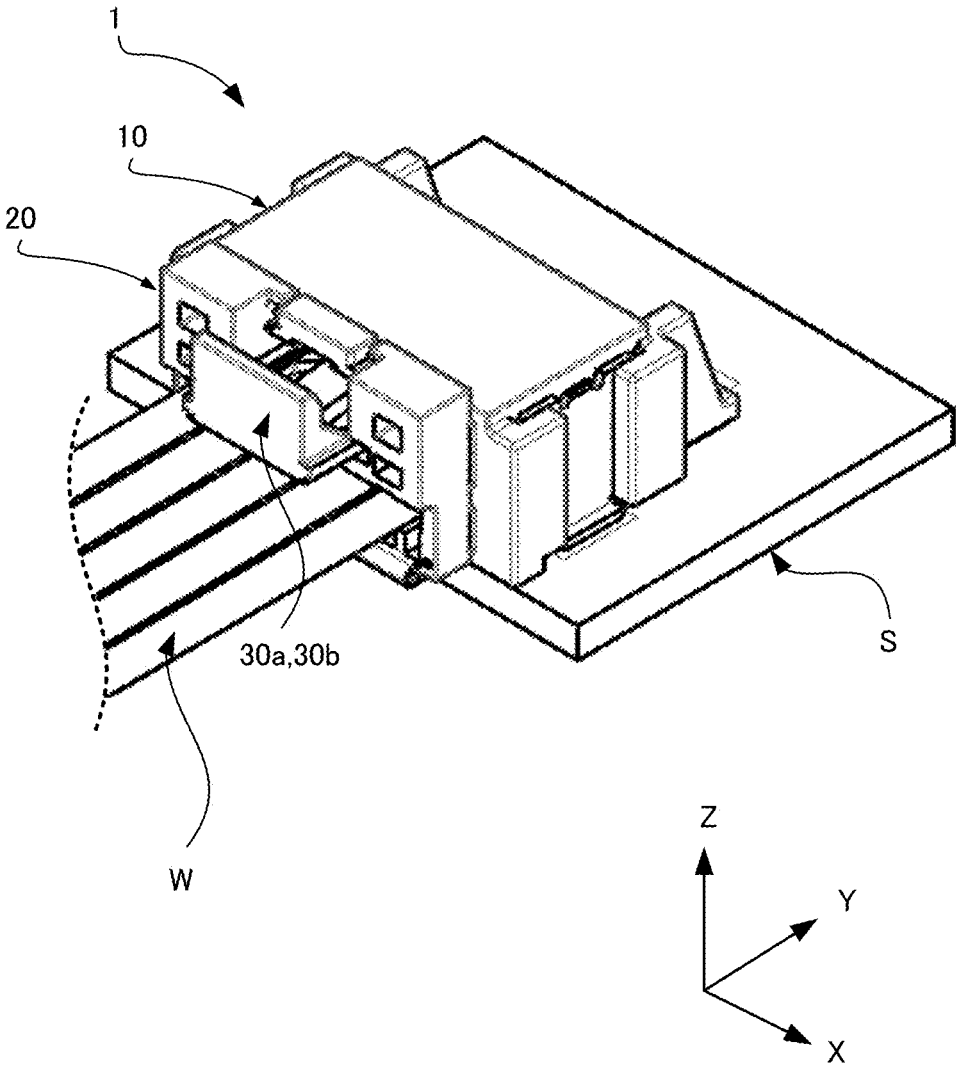
FIG. 1 is a perspective view illustrating a connector according to an embodiment of the present disclosure.
Figure 2:
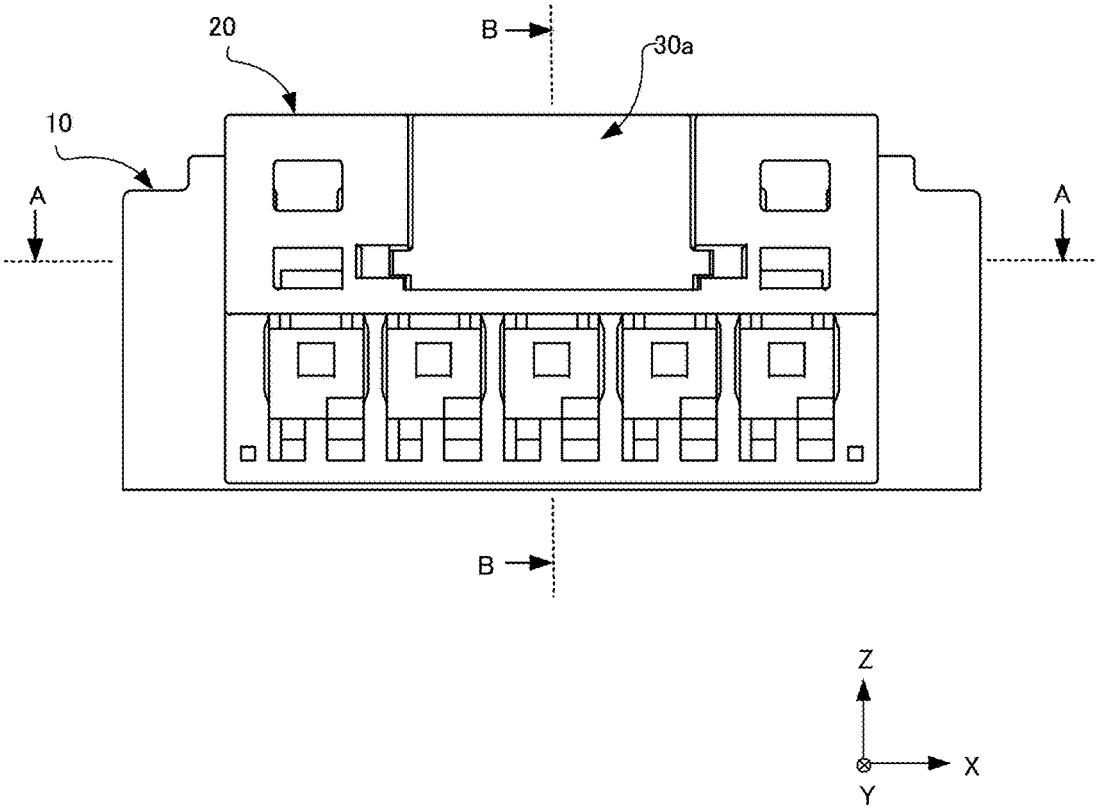
FIG. 2 is a front view illustrating the connector according to the embodiment of the present disclosure.

The connector 1 is applied to, for example, electronic circuit components for an automobile, and has a Connector Position Assurance (CPA) function. As illustrated in FIGS. 1 and 2, the connector 1 includes an outer housing 10 that is a first housing, an inner housing 20 that is a second housing, and a sliding member (CPA member) which is either a first sliding member 30*a* or a second sliding member 30*b* that becomes slidable upon engagement of both the outer housing 10 and the inner housing 20.

In this embodiment, the outer housing 10 is a housing of a receptacle connector mounted on a wiring board S. The outer housing 10 is formed of a plastic, and is formed by, for example, injection molding. The outer housing 10 is assembled with unillustrated multiple male terminals along the Y-axis direction. Each male terminal is formed by, for example, bending a conductive sheet material. The end of each male terminal at the +Y side is applied as an external lead to be soldered to the wiring board S.

The inner housing 20 is a housing of a plug connector to which wirings W are connected in this embodiment. The inner housing 20 is formed of a plastic, and is formed by, for example, injection molding. Unillustrated multiple female terminals are fitted in this inner housing 20. Each female terminal is formed by, for example, bending a conductive sheet material. The end of each female terminal at the +Y side is to be in contact with the end of the corresponding male terminal at the −Y side.

The sliding member 30*a* or the sliding member 30*b* serves as the CPA member that locks the engagement between both the outer and inner housings 10, 20. The sliding member 30*a* or 30*b* is applied so as to allow the user to check whether or not the engagement between both the outer and inner housings 10, 20 is fully completed within the engagement work.

Figure 3:
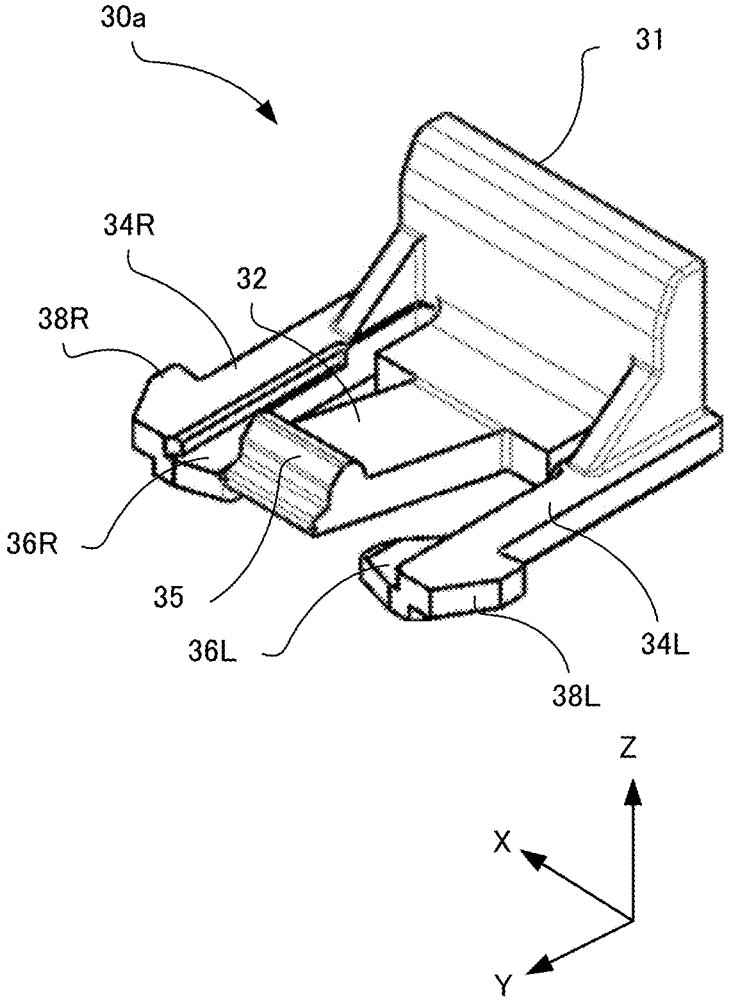
FIG. 3 is a perspective view illustrating a first sliding member according to the embodiment of the present disclosure.
Figure 4:
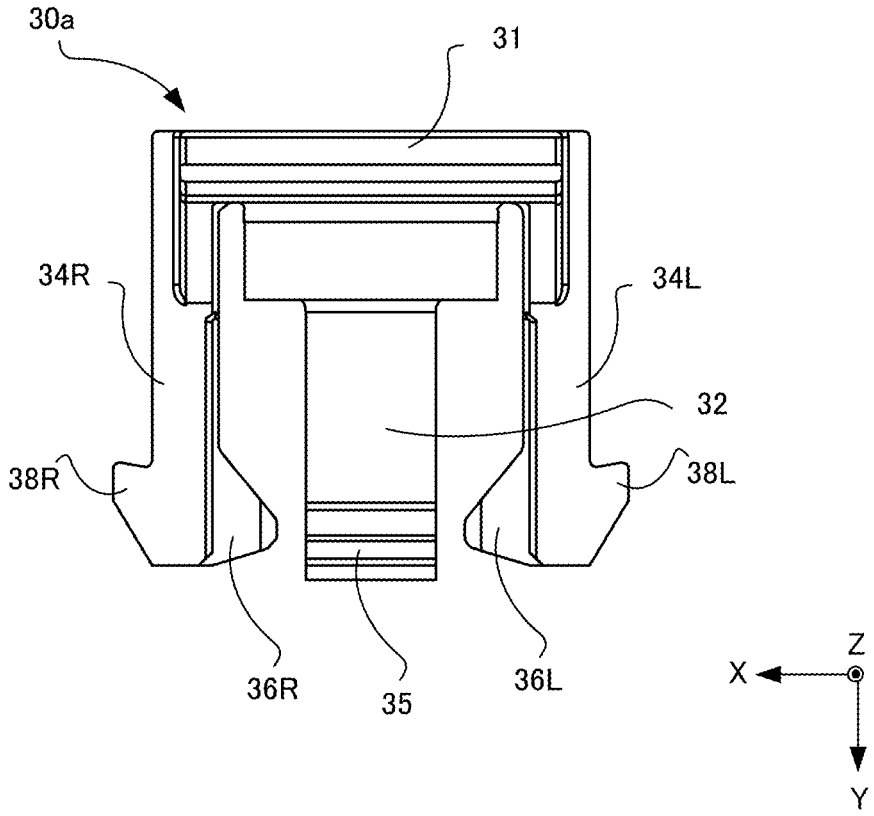
FIG. 4 is a top view illustrating the first sliding member according to the embodiment of the present disclosure.

As illustrated in FIGS. 3, 4, the sliding member 30*a* that is the first sliding member includes a sliding-member base 31, a main arm 32 that is a first arm protruding from the sliding-member base 31, a support arm 34R that is a second arm protruding from the sliding-member base 31, and a support arm 34L that is a third arm protruding from the sliding-member base 31.

The sliding-member base 31 is applied as a depressing part to be depressed by a finger when the user attempts to slide the sliding member 30*a*.

The main arm 32 is formed so as to protrude from the center lower part of the sliding-member base 31 toward the +Y side. A protrusion 35 that protrudes upwardly (+Z side) is formed at a leading end part (+Y side) of the main arm 32.

The support arms 34R, 34L are formed so as to protrude toward the +Y side from the lower end part of the sliding-member base 31 interpose the main arm 32. A protrusion 36R that is the first protrusion protruding inwardly (−X side) that is at the main-arm-32 side is formed at the leading end part (+Y side) of the support arm 34R. In addition, a protrusion 38R that protrudes outwardly (+X side) is also formed at such a leading end part. Still further, formed at the leading end part (+Y side) of the support arm 34L are a protrusion 36L that is a second protrusion protruding inwardly (+X side) which is at the main-arm-32 side, and a protrusion 38L that protrudes outwardly (−X side).

Figure 5:
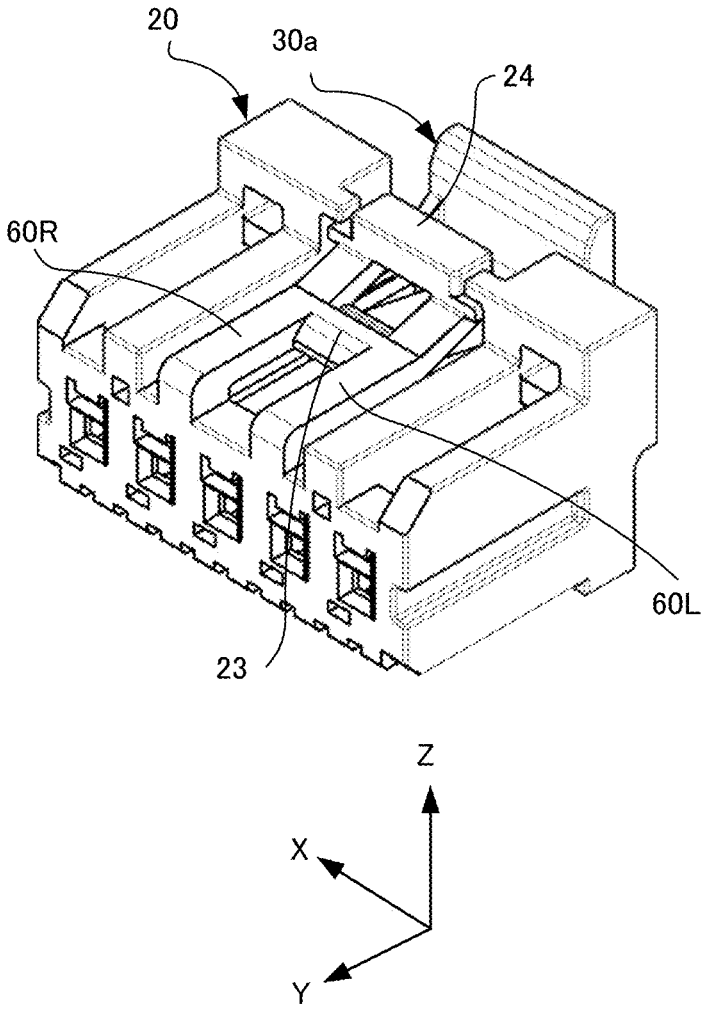
FIG. 5 is a top view illustrating the first sliding member being attached to an inner housing according to the embodiment of the present disclosure.
Figure 6:
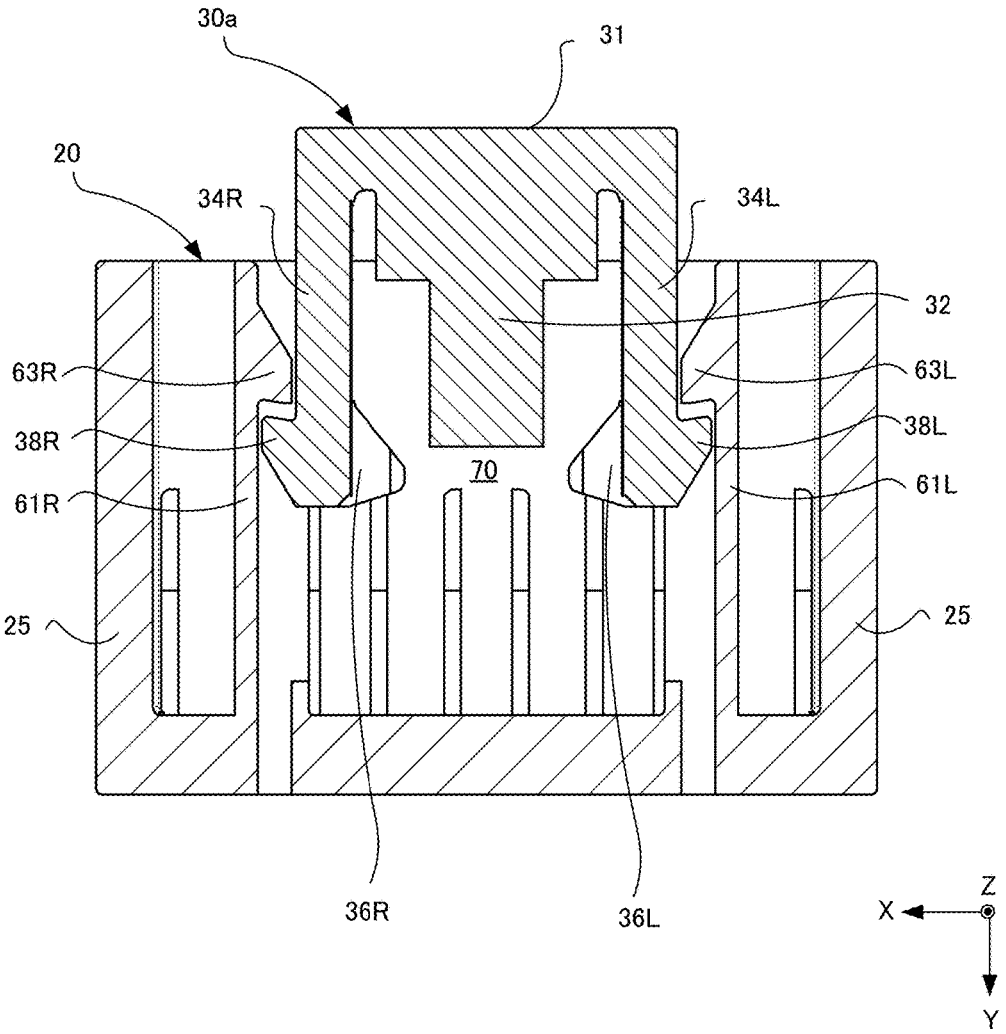
FIG. 6 is a cross-sectional view illustrating the first sliding member and the inner housing, and taken along a line A-A in FIG. 2 according to the embodiment of the present disclosure.
Figure 7:
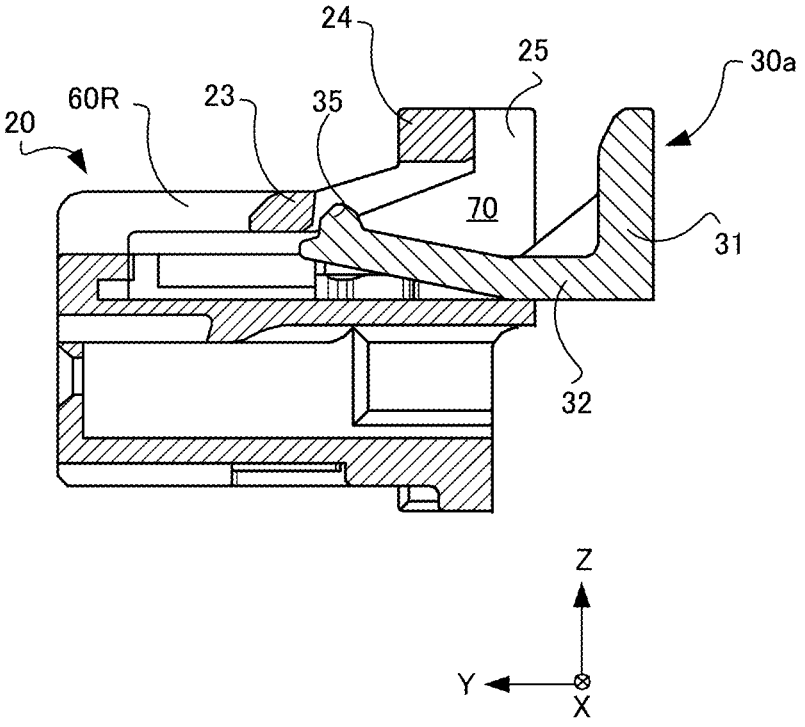
FIG. 7 is a cross-sectional view illustrating the first sliding member and the inner housing, and taken along a line B-B in FIG. 2 according to the embodiment of the present disclosure.

As illustrated in FIGS. 5 to 7, the inner housing 20 includes an engagement latch 23, a latching release 24, a rib 25, a pair of locking arms 60R, 60L, and a pair of reverse-fitting preventing ribs 61R, 61L. In FIGS. 6 and 7, the illustration of the outer housing 10 is omitted.

Figure 8:
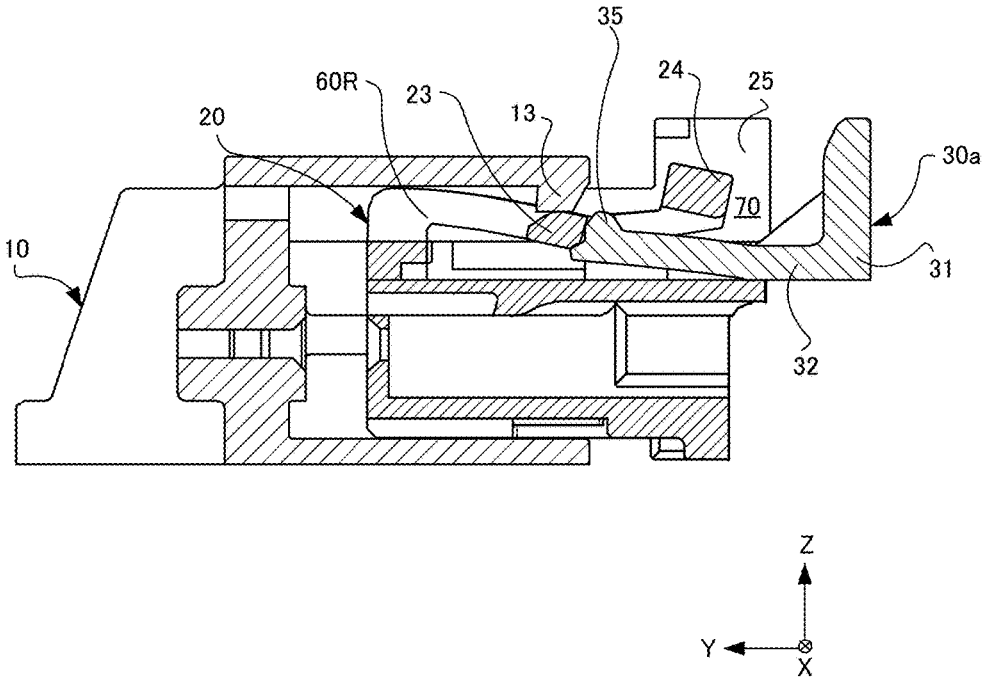
FIG. 8 is a (first) cross-sectional view for explaining an engagement between the outer housing and the inner housing, and taken along the line B-B in FIG. 2 according to the embodiment of the present disclosure.

The engagement latch 23 is provided between the locking arms 60R, 60L formed along the Y-axis direction so as to interconnect therebetween. When the inner housing 20 is fitted in the outer housing 10, and the engagement therebetween completes, the engagement latch 23 is latched with an engagement catch 13 formed at the outer housing 10 from the +Y side. The engagement catch 13 is formed on, for example, as illustrated in FIG. 8, the lower surface near the −Y side of a celling wall (the wall at the +Z side) that is a part of the wall defining the outer housing 10.

As illustrated in FIGS. 5 to 7, the latching release 24 is provided between the locking arms 60R, 60L so as to interconnect therebetween. When depressed by the user, the latching release 24 releases the engagement between the engagement latch 23 and the engagement catch 13 formed in the outer housing 10. The release of latching enables the user to detach the inner housing 20 from the outer housing 10.

The rib 25 is formed so as to improve the rigidity and strength of the inner housing 20. The rib 25 is formed along the Y-axis direction.

The reverse-fitting preventing rib 61R is formed along the Y-axis direction outwardly (+X side) relative to the locking arm 60R. In addition, the reverse-fitting preventing rib 61L is formed along the Y-axis direction outwardly (−X side) relative to the locking arm 60L. Provided between the reverse-fitting preventing rib 61R and the reverse-fitting preventing rib 61L is a space that is a slide channel 70. The slide channel 70 is a channel for enabling the sliding member 30*a* to slide and pass through, and is formed so as to enable the sliding member 30*a* to pass through upon engagement of both the outer and inner housings 10, 20.

Formed at the nearby end part of the reverse-fitting preventing rib 61R to the −Y side is a protrusion 63R that protrudes inwardly (−X side). In addition, formed at the nearby end part of the reverse-fitting preventing rib 61L to the −Y side is a protrusion 63L that protrudes inwardly (+X side).

When the engagement between both the outer and inner housings 10, 20 completes, the user who attempts to check the engagement condition between both the outer and inner housings 10, 20 slides the sliding member 30*a* along the slide channel 70 from the stand-by position to the engagement locking position toward the +Y side.

When the sliding member 30*a* is slid in the +Y-axis direction, the protrusions 38R, 38L of the sliding member 30*a* go over the protrusions 63R, 63L of the inner housing 20, respectively, and the protrusion 38R is latched with the protrusion 63R from the +Y side, while the protrusion 38L is latched with the protrusion 63L from the +Y side. Hence, the protrusions 63R, 63L serve as respective catches to be latched with the protrusions 38R, 38L.

Next, an explanation will be given of how to engage the outer housing 10 of the connector 1 and the inner housing 20 thereof employing the above structure with reference to FIGS. 7 to 10. As illustrated in FIG. 7, the sliding member 30*a* is attached to the inner housing 20 with the protrusion 35 formed at the main arm 32 abutting the engagement latch 23 of the inner housing 20, and the sliding action being restricted.

As illustrated in FIG. 8, when the inner housing 20 is moved in the fitting direction (+Y-axis direction) together with the sliding member 30*a*, and is fitted in the outer housing 10, the lower part (−Z side) of the engagement catch 13 of the outer housing 10 abuts the upper part (+Z side) of the engagement latch 23 of the inner housing 20. At this time, the condition in which the protrusion 35 of the sliding member 30*a* is abutting the engagement latch 23 of the inner housing 20 is maintained.

In the condition illustrated in FIG. 8, the engagement between both the outer and inner housings 10, 20 is not fully completed (incomplete engagement). When the sliding member 30*a* is further pushed in the +Y-axis direction, the protrusion 35 of the sliding member 30*a* is also moved in the +Y-axis direction together with the engagement latch 23 of the inner housing 20, and thus the incomplete engagement illustrated in FIG. 8 will be addressed later.

Figure 9:
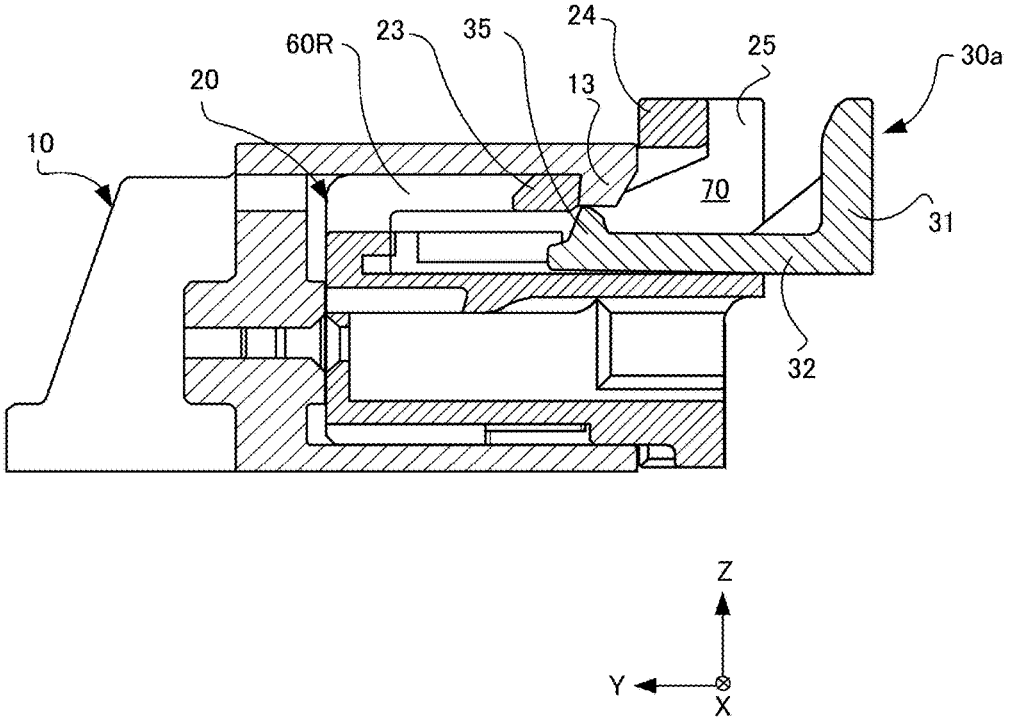
FIG. 9 is a (second) cross-sectional view for explaining the engagement between the outer housing and the inner housing, and taken along the line B-B in FIG. 2 according to the embodiment of the present disclosure.

In addition, when the inner housing 20 is further fitted in the outer housing 10, as illustrated in FIG. 9, the depressed engagement latch 23 by the engagement catch 13 is released, and thus the engagement latch 13 is returned in the +Z-axis direction, and is latched with the engagement catch 13 from the +Y side. Still further, the nearby part of the sliding member 30*a* to the protrusion 35 of the main arm 32 is deflected downwardly (−Z side), and the protrusion 35 abuts the lower part (−Z side) of the engagement catch 13 of the outer housing 10.

Hence, the engagement between the outer housing 10 of the connector 1 and the inner housing 20 thereof completes, and thus the inner housing 20 becomes unable to further move in the +Y-axis direction.

When the engagement between both the outer and inner housings 10, 20 completes, the user who attempts to check the engagement condition between both the outer and inner housings 10, 20 moves the sliding member 30*a* along the slide channel 70 toward the +Y side.

Figure 10:
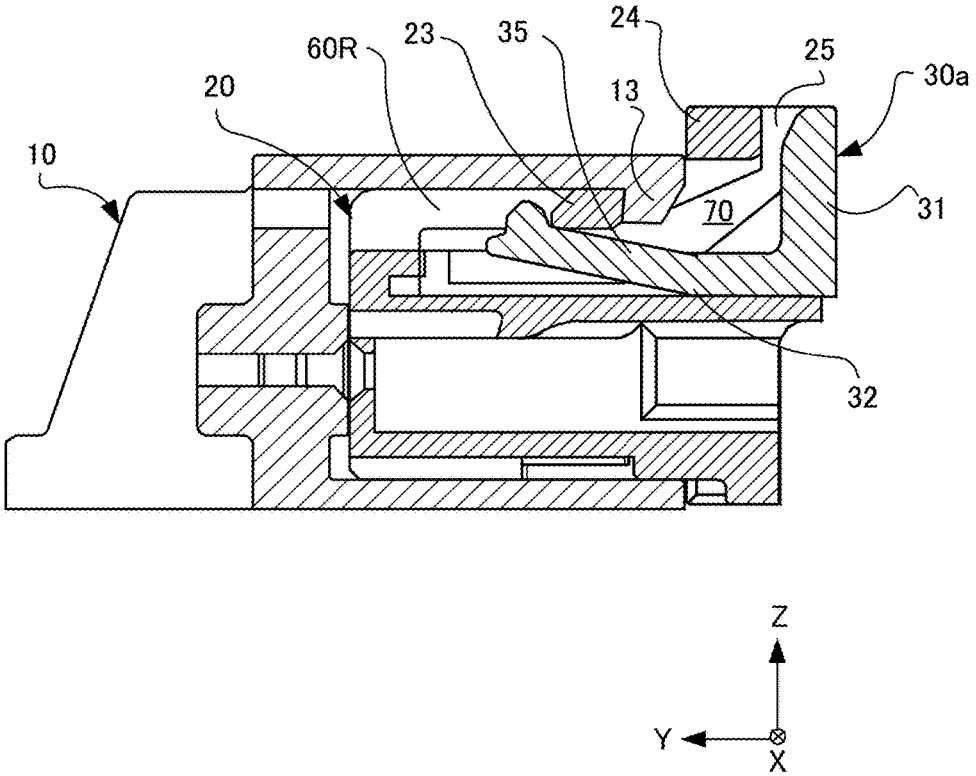
FIG. 10 is a (third) cross-sectional view for explaining the engagement between the outer housing and the inner housing, and taken along the line B-B in FIG. 2 according to the embodiment of the present disclosure.

When the sliding member 30*a* is slid in the +Y-axis direction, the protrusion 35 of the sliding member 30*a* is slid in the +Y-axis direction while abutting the lower part (−Z side) of the engagement latch 23 of the inner housing 20. In addition, as illustrated in FIG. 10, the protrusion 35 goes over the engagement latch 23, and thus the deflection of the main arm 32 is canceled. Hence, the protrusion 35 is returned to the upper side (+Z side) based on the elastic recovery of the main arm 32. Consequently, the protrusion 35 is latched with the engagement latch 23.

When the protrusion 35 is latched with the engagement latch 23, the main arm 32 is located at the −Z side relative to the engagement latch 23. Hence, the engagement latch 23 is prevented from moving by what corresponds to the necessary amount to release the latching with the engagement catch 13. This also prevents the engagement latch 13 from moving to the position that releases the latching. Consequently, the engagement between the outer housing 10 and the inner housing 20 is locked by the sliding member 30*a*.

In addition, when the sliding member 30*a* slides and passes through the slide channel 70, the protrusions 36R, 36L of the sliding member 30*a* are capable of moving within the slide channel 70 in a manner free from an interference with the inner housing 20. That is, the protrusions 36R, 36L are formed at the positions that do not disrupt the passing-through action of the sliding member 30*a* over the slide channel 70.

Next, an explanation will be given of how to detach the inner housing 20 of the connector 1 from the outer housing 10. When the engagement between the outer housing 10 and the inner housing 20 is to be released, first, the sliding member 30*a* is moved in the −Y-axis direction from the condition illustrated in FIG. 10. In this case, the nearby part of the sliding member 30*a* to the location where the protrusion 35 of the main arm 32 is formed is deflected downwardly (−Z side), the protrusion 35 abuts the lower part (−Z side) of the engagement catch 13 of the outer housing 10, and becomes a condition illustrated in FIG. 9. Subsequently, when the sliding member 30*a* is further moved in the −Y-axis direction, the sliding member 30*a* is pulled out from both the outer and inner housings 10, 20.

In addition, when the engagement release 24 of the inner housing 20 is depressed downwardly (−Z side), the engagement latch 23 is also moved downwardly (−Z side), and thus the latching between the engagement latch 23 and the engagement catch 13 of the outer housing 10 is released. When the latching is released, the inner housing 20 becomes a condition that can be pulled out from the outer housing 10 in the −Y-axis direction, and is detached therefrom.

Figure 11:
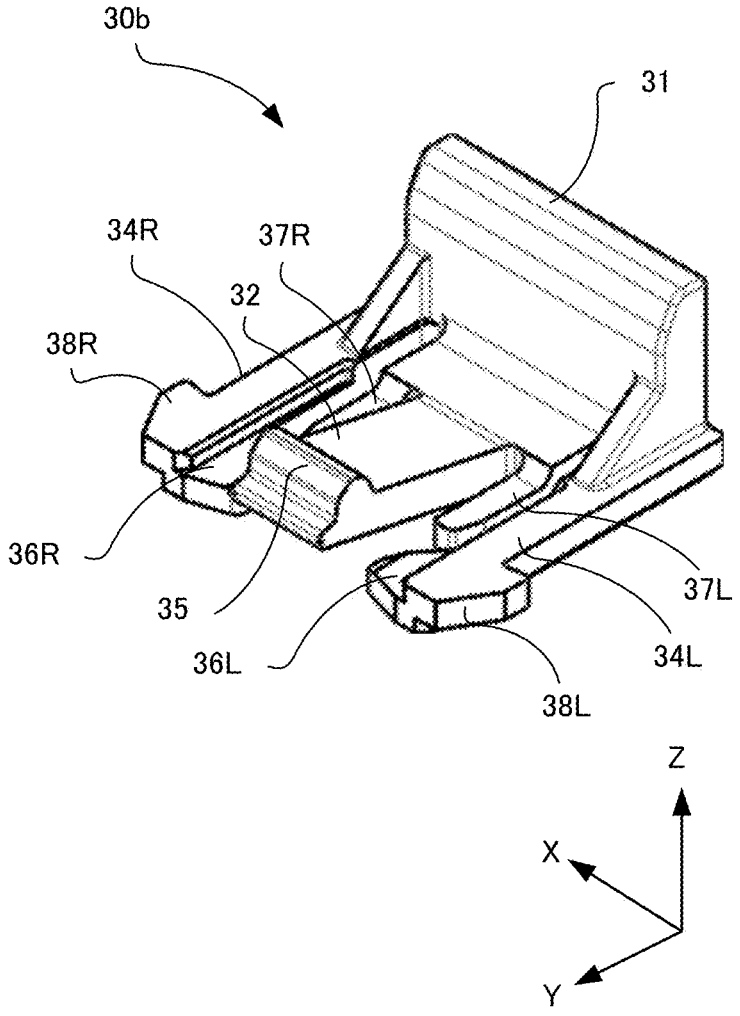
FIG. 11 is a perspective view illustrating a second sliding member according to the embodiment of the present disclosure.
Figure 12:
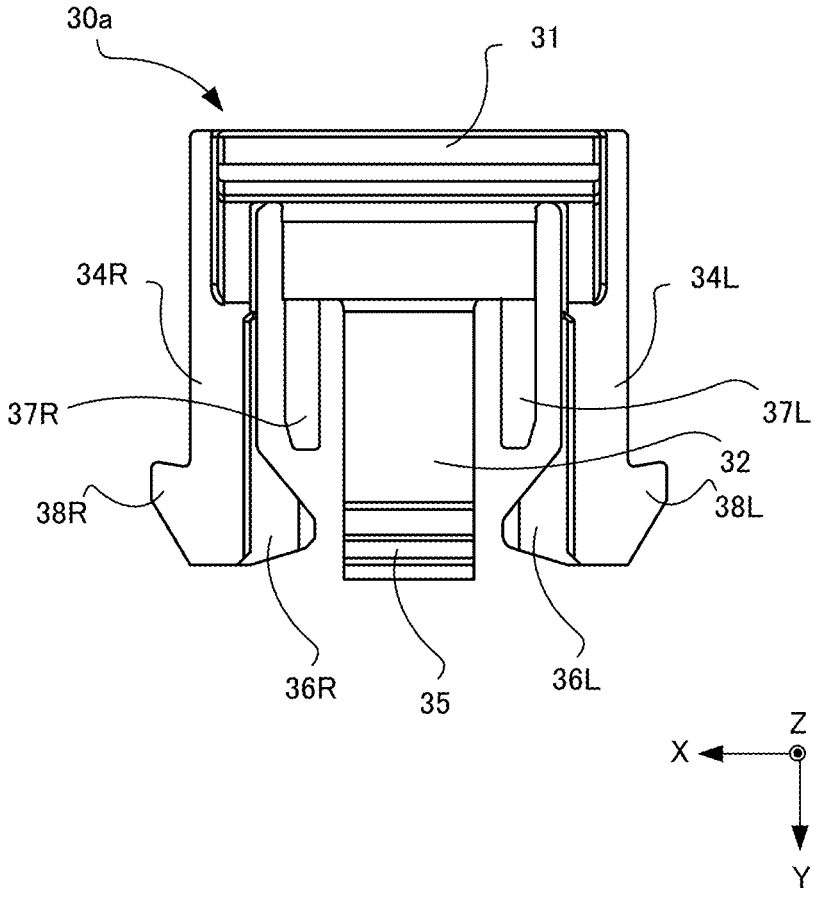
FIG. 12 is a top view illustrating the second sliding member according to the embodiment of the present disclosure.

Next, an explanation will be given of the sliding member 30*b* that is the second sliding member. As illustrated in FIGS. 11 and 12, the sliding member 30*b* includes the sliding-member base 31, the main arm 32 that is the first arm protruding from the sliding-member base 31, the support arm 34R that is the second arm protruding from the sliding-member base 31, the support arm 34L that is the third arm protruding from the sliding-member base 31, an arm 37R that is a fourth arm protruding from the sliding-member base 31, and an arm 37L that is a fifth arm protruding from the sliding-member base 31.

Since the sliding-member base 31, the main arm 32, the support arms 34R, 34L, the protrusion 35 formed at the main arm 32, the protrusions 36R, 38R formed at the support arm 34R, and the protrusions 36L, 38L formed at the support arm 34L employ the same structures as those of the sliding member 30*a*, the redundant detailed explanation thereof will be omitted.

The arm 37R protrudes in the +Y-axis direction from the part of the sliding-member base 31 between the protruding main arm 32 and the protruding support arm 34R. In addition, the arm 37L protrudes in the +Y-axis direction from the part of the sliding-member base 31 between the protruding main arm 32 and the protruding support arm 34L.

Since the engagement method for the outer housing 10 of the connector 1 and the inner housing 20 thereof when the sliding member 30*b* is applied is the same as the method when the above sliding member 30*a* is applied, the redundant detailed explanation thereof will be omitted.

Figure 13:
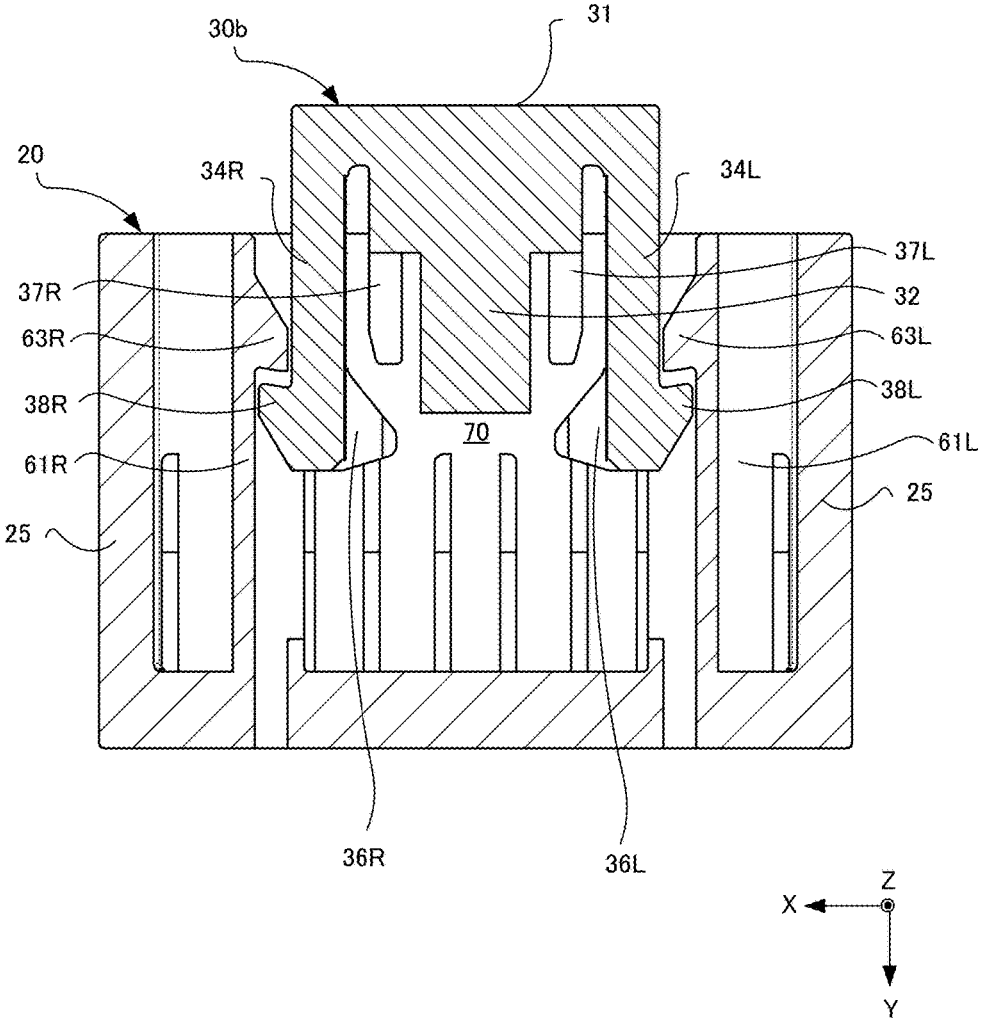
FIG. 13 is a cross-sectional view of the second sliding member and the inner housing, and taken along the line A-A in FIG. 2 according to the embodiment of the present disclosure.

In FIG. 13, when the sliding member 30*b* slides and passes through the slide channel 70, the protrusions 36R, 36L and the arms 37R, 37L move within the slide channel 70 in a manner free from an interference with the inner housing 20. That is, the protrusions 36R, 36L, and the arms 37R, 37L are formed at locations that do not disrupt the passing-through action of the sliding member 30*b* over the slide channel 70.

Figure 14:
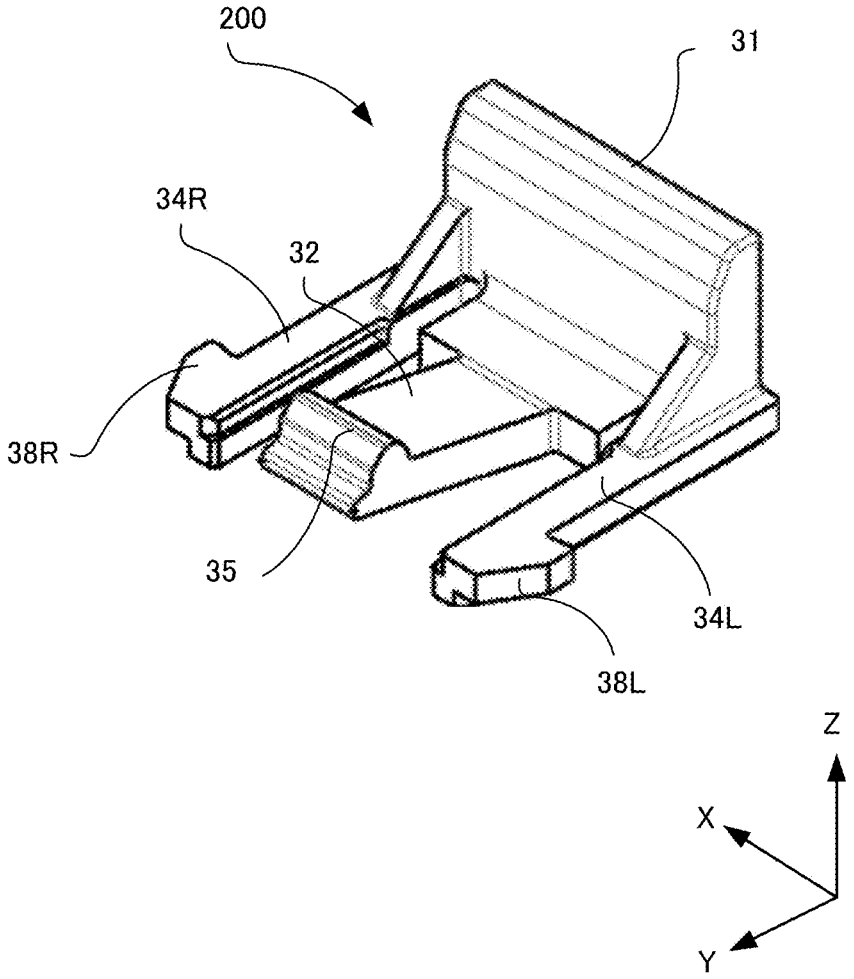
FIG. 14 is a perspective view illustrating a conventional sliding member.

As illustrated in FIG. 14, an example conventional sliding member 200 includes, like the sliding members 30*a*, 30*b* of this embodiment, the sliding-member base 31, the main arm 32 protruding from the sliding-member base 31, the support arm 34R protruding from the sliding-member base 31, and the support arm 34L protruding from the sliding-member base 31. In addition, this conventional sliding member 200 includes, like the sliding members 30*a*, 30*b* of this embodiment, the protrusion 35 which is formed at the leading end part (+Y side) of the main arm 32, and which protrudes upwardly (+Z side), the protrusion 38R which is formed at the leading end part (+Y side) of the support arm 34R, and which protrudes outwardly (+X side), and the protrusion 38L which is formed at the leading end part (+Y side) of the support arm 34L, and which protrudes outwardly (−X side).

According to the conventional sliding member 200, however, unlike the sliding members 30*a*, 30*b* of this embodiment, no protrusion 36R which protrudes inwardly (−X side) that is at the main-arm-32 side is formed at the leading end part (+Y side) of the support arm 34R, and no protrusion 36L which protrudes inwardly (+X side) that is at the main-arm-32 side is formed at the leading end part (+Y side) of the support arm 34L. In addition, according to the conventional sliding member 200, unlike the sliding member 30*b* of this embodiment, no arm 37R that protrudes toward the +Y side from the part of the sliding member 31 between the protruding main arm 32 and the protruding support arm 34R is formed, and no arm 37L that protrudes toward the +Y side from the part of the sliding-member base 31 between the protruding main arm 32 and the protruding support arm 34L is formed.

Figure 15:
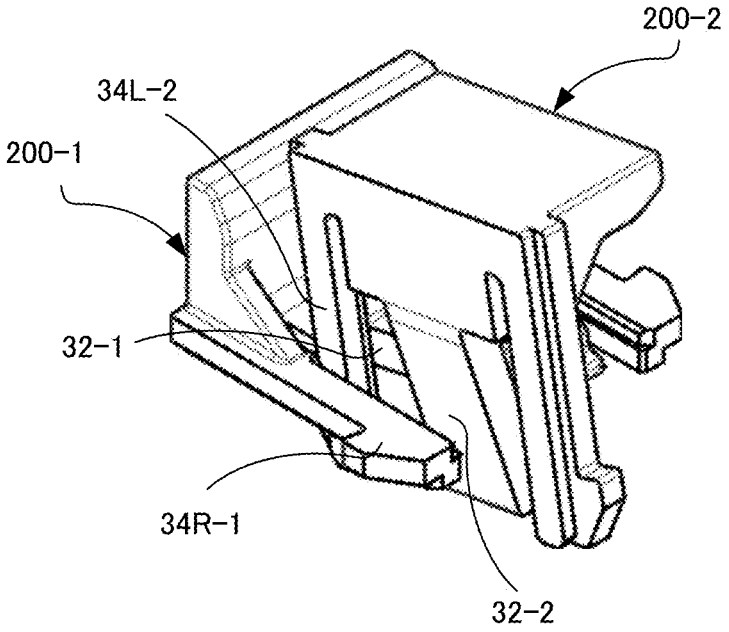
FIG. 15 is a perspective view illustrating how conventional sliding members are entangled with each other.

Based on such differences, according to the conventional sliding member 200, a wide gap is formed between the main arm 32 and the support arm 34R, 34L. Hence, for example, as illustrated in FIG. 15, the conventional sliding members 200-1 and 200-2 may be entangled with each other within a part feeder that supplies the sliding members to an assembling machine that assembles the connector, and thus a possibility that the main arm 32-2 of the sliding member 200-2 and the support arm 34L-2 thereof enter the space between the main arm 32-1 of the sliding member 200-1 and the support arm 34R-1 thereof is high.

In contrast, according to the sliding member 30*a* of this embodiment, the protrusion 36R which protrudes inwardly (−X side) that is at the main-arm-32 side is formed at the leading end part (+Y side) of the support arm 34R, and the protrusion 36L which protrudes inwardly (+X side) that is at the main arm 32 side is formed at the leading end part (+Y side) of the support arm 34L.

Figure 16:
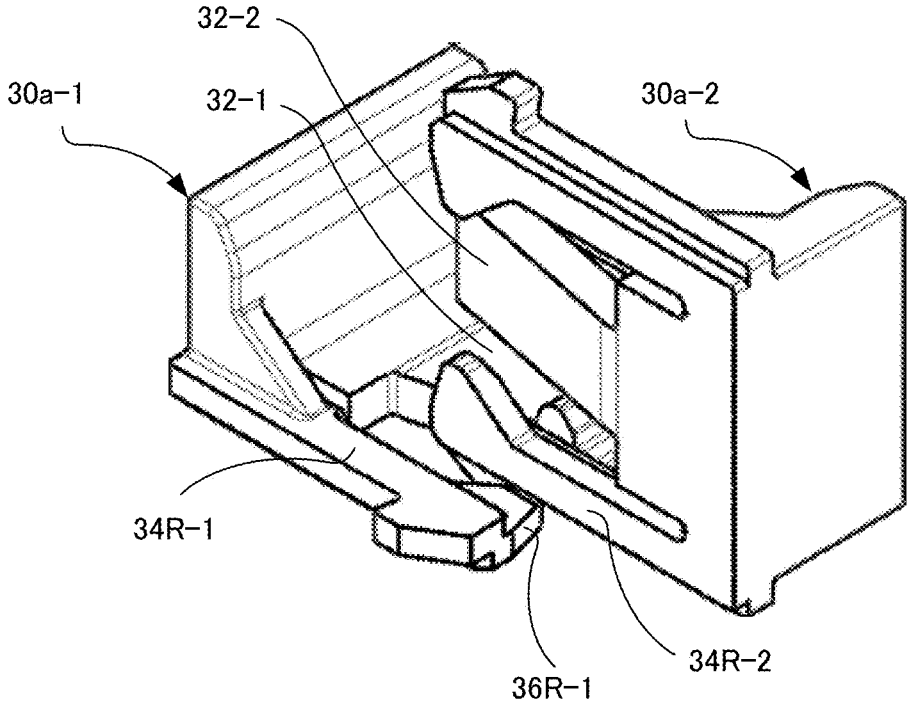
FIG. 16 is a perspective view illustrating the first sliding members that are not entangled with each other according to the embodiment of the present disclosure.

Hence, the sliding member 30*a* of this embodiment is capable of decreasing the gap between the main arm 32 and the support arm 34R, 34L, decreasing the possibility that the respective sliding members 30*a* are entangled with each other in the part feeder. For example, as illustrated in FIG. 16, as for the sliding members 30*a*-1 and 30*a*-2, the sliding member 30*a*-1 is formed with the protrusion 36R-1. This decreases the possibility that the main arm 32-2 of the sliding member 30*a*-2 and the support arm 34R-2 thereof enter the space between the main arm 32-1 of the sliding member 30*a*-1 and the support arm 34R-1 thereof.

Still further, according to the sliding member 30*b* of this embodiment, formed in addition to the protrusions 36R, 36L are the arm 37R that protrudes toward the +Y side from the part of the sliding base member 31 between the protruding main arm 32 and the protruding support arm 34R, and the arm 37L that protrudes toward the +Y side from the part of the sliding base member 31 between the protruding main arm 32 and the protruding support arm 34L.

Figure 17:
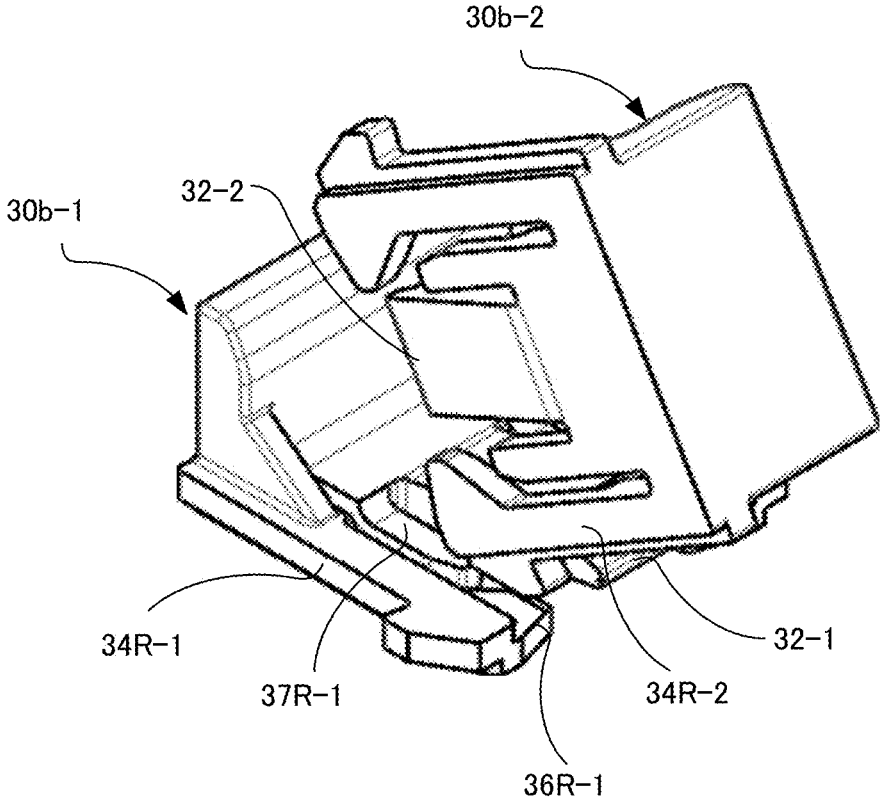
FIG. 17 is a perspective view illustrating the second sliding members that are not entangled with each other according to the embodiment of the present disclosure.

Hence, according to the sliding member 30*b* of this embodiment, in comparison with the sliding member 30*a*, a part of the gap between the main arm 32 and the support arm 34R, 34L is further eliminated, further decreasing the possibility that the respective sliding members 30*b* are entangled with each other in the part feeder. For example, in FIG. 17, as for the sliding members 30*b*-1 and 30*b*-2, the protrusion 36R-1 is formed at the sliding member 30*b*-1, and the arm 37R-1 is formed. This decreases the possibility that the main arm 32-2 of the sliding member 30*b*-2 and the support arm 34R-2 thereof enter the space between the main arm 32-1 of the sliding member 30*b*-1 and the support arm 34R-1.

Yet still further, according to the sliding member 30*a* of this embodiment, the protrusions 36R, 36L are formed at locations that do not disturb the passing-through action of the sliding member 30*a* over the slide channel 70. In addition, according to the sliding member 30*b* of this embodiment, the protrusions 36R, 36L, and the arms 37R, 37L are formed at locations that do not disturb the passing-through action of the sliding member 30*b* over the slide channel 70. Hence, no fitting of the sliding members 30*a*, 30*b* to the inner housing 20 is disturbed.

The embodiment of the present disclosure has been explained, but the present disclosure is not limited to the above embodiment.

For example, according to the above embodiment, the outer housing 10 is the housing of a receptacle connector to be mounted on the wiring board S, while the inner housing 20 is the housing of the plug connector to be connected with the wiring W. However, the present disclosure is not limited to this structure. For example, both the housings may include respective terminals, and the wirings W may be connected thereto.

In addition, according to the sliding member 30*b* of the above embodiment, in order to eliminate the gap between the main arm 32 and the support arm 34R, 34L, the protrusions 36R, 36L, and the arms 37R, 37L are formed, but only the arms 37R, 37L may be formed.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A connector comprising:

a first housing;

a second housing comprising a slide channel, the second housing being to be engaged with the first housing; and a sliding member capable of passing through the slide channel, and locking an engagement between the first housing and the second housing when moved to a predetermined position, wherein the sliding member comprises:

a base;

a first arm protruding from the base in a predetermined direction;

second and third arms protruding from the base in the predetermined direction and interposing the first arm between the second and third arms;

a first protrusion formed at a leading end of the second arm and protruding in a direction toward the first arm, the first protrusion decreasing the gap between the first arm and the second arm; and a second protrusion formed at a leading end of the third arm and protruding in the direction toward the first arm, the second protrusion decreasing the gap between the first arm and the third arm, a fourth arm protruding in the predetermined direction from a part of the base between the first arm and the second arm; and a fifth arm protruding in the predetermined direction from a part of the base between the first arm and the third arm, and wherein:

the fourth arm is shorter than the first arm and the second arm and protrudes without coming into contact with the first protrusion; and the fifth arm is shorter than the first arm and the third arm and protrudes without coming into contact with the second protrusion.

2. The connector according to claim 1, wherein the first protrusion and the second protrusion are provided at locations free from an interference with a passing-through action of the sliding member over the slide channel.

3. The connector according to claim 1, wherein the fourth arm and the fifth arm are formed at locations free from an interference with the passing-through action of the sliding member over the slide channel.

4. The connector according to claim 1, further comprising a third protrusion protruding from a leading end of the first arm.

* * * * *